US007631586B2

(12) United States Patent
Agata et al.

(10) Patent No.: US 7,631,586 B2
(45) Date of Patent: Dec. 15, 2009

(54) CUTTING TOOL

(75) Inventors: Kiyonobu Agata, Moriguchi (JP); Kozo Agata, Moriguchi (JP)

(73) Assignee: Kinki Knives Industries Ltd., Moriguchi-shi (JP)

( * ) Notice: Subject to any disclaimer, the term of this patent is extended or adjusted under 35 U.S.C. 154(b) by 483 days.

(21) Appl. No.: 10/562,684
(22) PCT Filed: Nov. 19, 2004

(86) PCT No.: PCT/JP2004/017269

§ 371 (c)(1),
(2), (4) Date: Dec. 28, 2005

(87) PCT Pub. No.: WO2005/053918
PCT Pub. Date: Jun. 16, 2005

(65) Prior Publication Data

US 2006/0156891 A1 Jul. 20, 2006

(30) Foreign Application Priority Data

Dec. 4, 2003 (JP) ..... 2003-405914
May 10, 2004 (JP) ..... 2004-139491

(51) Int. Cl.
*B26D 3/00* (2006.01)
*B26D 3/14* (2006.01)
*B26D 1/00* (2006.01)
*B26D 7/26* (2006.01)

(52) U.S. Cl. ..... 83/332; 83/671; 83/678; 83/917; 83/698.51; 493/365; 493/373

(58) Field of Classification Search ..... 83/671, 83/332, 668, 917, 677, 918, 333, 500, 911, 83/678, 683, 692, 406, 345, 698.51, 698.41, 83/346; 493/365, 354, 60, 403, 342, 368, 493/82, 83, 373
See application file for complete search history.

(56) References Cited

U.S. PATENT DOCUMENTS 2,117,220 A * 5/1938 Sieg ..... 493/354

(Continued)

FOREIGN PATENT DOCUMENTS

EP 2039482 * 3/2009

(Continued)

*Primary Examiner*—Boyer D. Ashley
*Assistant Examiner*—Laura M. Lee
(74) *Attorney, Agent, or Firm*—Kratz, Quintos & Hanson, LLP

(57) ABSTRACT

The present invention provides a cutting tool which can easily prevent damage from occurring at the slit end formed on a sheet material, such as a corrugated sheet or the like. Such a cutting tool is a cutting tool for forming a slit on a sheet material, the cutting tool including: a cutting tool body 11, a grooving blade 13 for forming a slit, and a notching blade 12 for forming an end portion of a slit, wherein the cutting tool body 11 is formed in the shape of a fan, the grooving blade 13 is formed along either edge in the thickness direction of the cutting tool body 11, the notching blade 12 is provided with a semi-cylindrical blade edge and an attachment site capable of being detachably attached to one end of the cutting tool body 11, and the notching blade 12 is attached to one end of the cutting tool body 11 in such a manner that an outer curved surface of the blade edge is exposed to the outside rather than being in contact with one end of the cutting tool body 11, and the attachment site is configured such that the blade edge can be adjusted in the radial direction of the cutting tool body 11.

7 Claims, 14 Drawing Sheets

U.S. PATENT DOCUMENTS

| | | | | | |
|---|---|---|---|---|---|
| 2,718,828 | A | * | 9/1955 | Chester et al. | 493/228 |
| 3,003,403 | A | * | 10/1961 | Goettsch | 493/365 |
| 3,036,486 | A | * | 5/1962 | Wilcox | 83/671 |
| 3,211,066 | A | * | 10/1965 | Palamenti | 493/365 |
| 3,236,137 | A | * | 2/1966 | Young | 83/671 |
| 3,237,501 | A | * | 3/1966 | Hottendorf | 83/671 |
| 3,353,460 | A | * | 11/1967 | Henc | 493/365 |
| 3,518,922 | A | * | 7/1970 | Kuehn | 493/365 |
| 3,544,377 | A | * | 12/1970 | Justi et al. | 429/21 |
| 3,575,091 | A | * | 4/1971 | LaBantschnig | 493/365 |
| 3,594,779 | A | * | 7/1971 | Kitz | 345/43 |
| 3,664,240 | A | * | 5/1972 | Helm | 493/403 |
| 3,772,953 | A | * | 11/1973 | Sullivan | 83/332 |
| 3,880,056 | A | * | 4/1975 | Dohnalik | 493/403 |
| 4,167,884 | A | * | 9/1979 | Santanna | 83/671 |
| 4,725,261 | A | * | 2/1988 | Millard et al. | 493/82 |
| 4,819,534 | A | * | 4/1989 | Sanchez | 83/671 |
| 5,144,874 | A | * | 9/1992 | Garrett | 83/332 |
| 5,174,184 | A | * | 12/1992 | Meeks | 83/332 |
| 5,297,462 | A | * | 3/1994 | Creaden | 83/305 |
| 5,336,154 | A | * | 8/1994 | Focke et al. | 493/352 |
| 5,890,409 | A | * | 4/1999 | Carlton et al. | 83/678 |

FOREIGN PATENT DOCUMENTS

| | | | |
|---|---|---|---|
| JP | 166095/1989 | | 11/1989 |
| JP | 6-27128 | | 4/1994 |
| JP | 8-192390 | | 7/1996 |
| JP | 9-39118 | | 2/1997 |
| JP | 9-85854 | | 3/1997 |
| JP | 2003-25277 | | 1/2003 |
| NL | 9001606 | * | 2/1992 |

* cited by examiner

CUTTING TOOL

This Application is based on and hereby claims priority to PCT Application No. PCT/JP04/17269 filed on 19 Nov. 2004 and Japanese Application No. 2004-139491 filed on 10 May 2004 and Japanese Application No. 2003-405914 filed on 4 Dec. 2003, the contents of which are hereby incorporated by reference.

TECHNICAL FIELD

The invention relates to a cutting tool.

BACKGROUND OF THE INVENTION

A corrugated box obtained by folding a corrugated sheet 50 as shown in FIG. 9 is known as a packing box for storing or moving objects. The upper lid and the base plate of a corrugated box is formed by overlapping separated parts that are obtained by using slits formed at some parts of the corrugated sheet 50.

The slits are usually formed using a grooving device. A cutting tool 60 as shown in FIG. 10 is well known for use as the grooving device (see BACKGROUND OF THE INVENTION of Patent Document 1. Japanese Unexamined Patent Publication No. 1997-39118, for example).

In the cutting tool 60, a notching blade 62 and a grooving blade 63 are integrally formed on a fan-shaped cutting tool body 61. The notching blade 62 projects outwards radially from one end of the outer surface of the cutting tool body 61 in such a manner as to be flush with the end surface of the cutting tool body 61, and is provided with an angled portion 64 on either side of the end surface in the width direction. The grooving blade 63 is formed on either side of the cutting tool body 61 in the thickness direction along the outer surface of the cutting tool body 61.

The cutting tool 60 is attached to a grooving device 70 as shown in FIGS. 11 and 12. FIG. 11 is a side view schematically showing the grooving device, and FIG. 12 is an elevation view of FIG. 11. The grooving device 70 is equipped with two cutting tools 60, which are referred to as cutting tools 60*a* and 60*b*. The construction of the grooving device is described below.

The grooving device 70 is provided with an upper rotation axis 71 and a lower rotation axis 72.

The upper rotation axis 71 and the lower rotation axis 72 are positioned in parallel facing each other across a sheet feed line L, and are provided with a pair of disk-like upper rotation holders 73 and 73, and a pair of lower rotation holders 74 and 74, respectively.

Each of the two cutting tools 60*a* and 60*b* is held between the pair of lower rotation holders 73 and 73 with a fastening member (not shown), such as a bolt. The cutting tools 60*a* and 60*b* are disposed at given intervals along the outer surface of the pair of rotation holders 73 and 73 in such a manner that the notching blades 62*a* and 62*b* face each other along the direction of the periphery.

On the other hand, the pair of lower rotation holders 74 and 74 are provided with two receiving blades 75 and 75 on their opposing sides at given intervals in such a manner as to match with the thickness of the cutting tools 60*a* and 60*b*.

An explanation as to how to form a slit in the corrugated sheet 50 using the grooving device 70 configured as described above is given below. As shown in FIG. 11, while the pair of upper rotation holders 73 and 73 and the pair of lower rotation holders 74 and 74 are rotated, the corrugated sheet 50 is fed to the grooving device 70 from the right, as seen from FIG. 11, along the sheet feed line L of the grooving device 70. By the rotation of the holders, the cutting tool 60*a* is placed in the gap between the receiving blades 75 and 75 to cut the corrugated sheet 50, thereby forming a front slit 51 which extends from a slit terminal end 53 as shown in FIG. 9. In the same manner, the other cutting tool 60*b* is placed in the gap between the receiving blades 75 and 75 to cut the corrugated sheet 50, thereby forming a back slit 52 which extends from the slit beginning portion 54.

Patent Document 2, Japanese Examined Utility Model Publication No. 1994-1356, teaches a construction in which a cutting tool is provided with notches on either side of the cutting tool body, and notching blades are detachably attached to the notches.

SUMMARY OF THE INVENTION

The cutting tool 60 of Patent Document 1 is disadvantageous in that a slit beginning portion 54 of the back slit 52 may be damaged, such as a split, during the formation of the slit. More specifically, as shown in FIG. 13, the end surface of the notching blade 62*b* depresses the side wall of the beginning portion 54 of the back slit 52 when forming a notch at the beginning portion 54 of the back slit 52. Moreover, as shown in FIG. 14, when the notching blade 62*b* moves upward cutting through the corrugated sheet 50 during rotation of the upper rotation holder 73 in the direction of the arrow, the notching blade 62*b* pushes up the side wall of the beginning portion 54 on contact with the beginning portion 54 of the back slit 52. In this state, an angled portion 64 formed at the contact surface between the notching blade 62*b* of the prior-art cutting tool 60*b* and the beginning portion 54 of the back slit 52 causes damage, such as a split from the angled portion 64, to the beginning portion of the back slit when the end surface of the notching blade 62*b* depresses or pushes up the side wall of the beginning portion 54 of the back slit 52. Since the damage, such as a split, appears in a corner part of the corrugated box manufactured by folding the corrugated sheet 50, the cosmetic appearance is impaired and the strength of the corrugated box may possibly be reduced.

In order to prevent the damage from occurring at the slit end of the corrugated sheet, Patent Document 1 proposes using a cutting tool which is not provided with the notching blade that causes the damage, and separately providing a cutter device for forming a notch beforehand at a position corresponding to the slit end of the corrugated sheet.

However, the grooving device of Patent Document 1 thus requires another cutter device, which unfavorably increases the production cost. Moreover, in order to precisely form a notch at the position corresponding to the slit end using a cutter device, the position adjustment of the cutter of the cutter device with respect to the corrugated sheet and the timing adjustment for forming the notch are necessary, which complicates the process.

The present invention has been made to solve the above problems, and aims to provide a cutting tool which can easily and surely prevent damage from occurring at the end portion of the slit formed in a sheet material, such as a corrugated sheet or the like.

The above-described object of the invention can be achieved by a cutting tool including: a cutting tool body, a grooving blade for forming a slit, and a notching blade for forming an end portion of a slit, wherein the cutting tool body is formed in the shape of a fan, the grooving blade is formed along either edge in the thickness direction of the cutting tool body, the notching blade is provided with a semi-cylindrical blade edge and an attachment site capable of being detachably attached to one end of the cutting tool body, and the notching blade is attached to one end of the cutting tool body in such a manner that an outer curved surface of the blade edge is exposed to the outside rather than being in contact with one end of the cutting tool body, and the attachment site is configured such that the blade edge can be adjusted in the radial direction of the cutting tool body.

Preferably, the cutting tool is configured such that the attachment site is provided with an oblong hole, and the notching blade is attached to the cutting tool body by inserting a bolt, via the oblong hole, into a bolt hole formed in one end of the cutting tool body.

Also preferably, the cutting tool has a configuration such that the blade edge is disposed inside rather than outside in the radial direction with respect to the outer periphery of the cutting tool body, and the notching blade can be held.

Further preferably, in the cutting tool, the cutting tool body has a notch formed on one end, which forms a back face inclined at an angle of 5° to 30° to an end surface, and the notching blade is attached to the back face.

Still further preferably, in the cutting tool, the notching blade is provided with a notch at the tip of the blade.

Still further preferably, in the cutting tool, the width of the notching blade is shorter by 0.1 mm to 0.3 mm than that of the cutting tool body.

The present invention can provide a cutting tool which can easily prevent damage from occurring at the slit end formed on a sheet material, such as a corrugated sheet or the like.

DESCRIPTION OF THE REFERENCE NUMERALS

Figure 1:
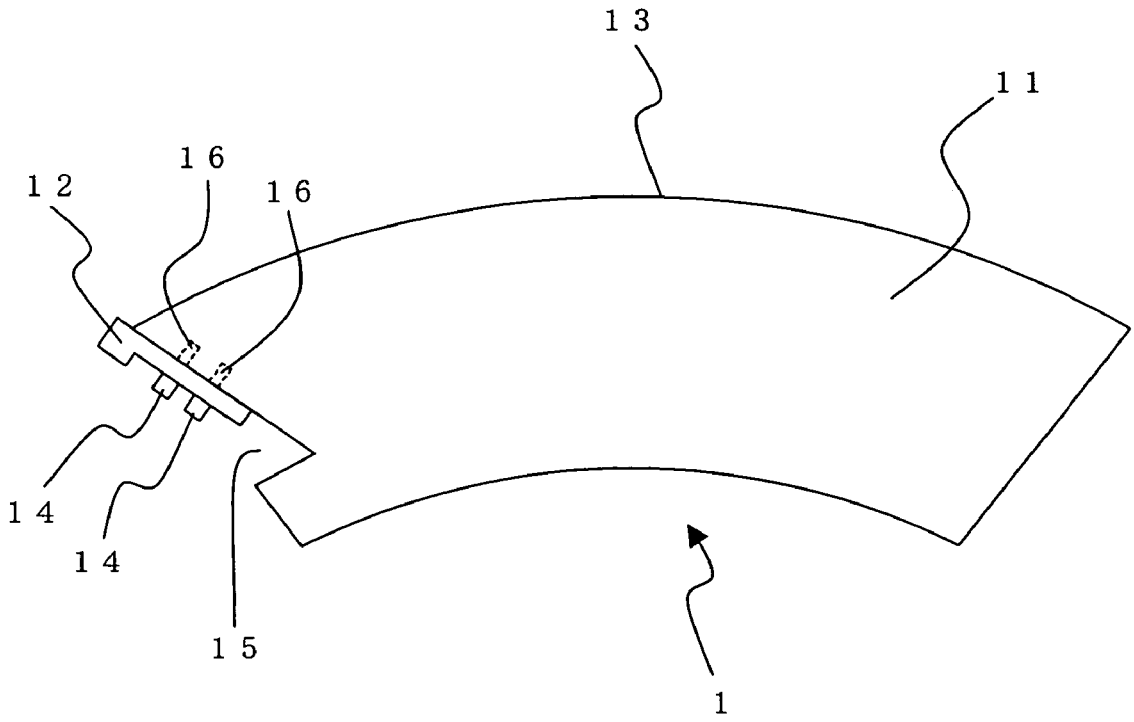
FIG. 1 is a plan view showing a cutting tool according to one embodiment of the invention.

1. cutting tool
11. cutting tool body
12. notching blade
13. grooving blade
14. bolt
15. notch
16. attachment hole
17. back face
18. end surface
21. blade edge
22. attachment site
23. oblong hole
26. notch
50. corrugated sheet
51. front slit
52. back slit
53. slit terminal end
54. slit beginning portion

BEST MODE FOR CARRYING OUT THE INVENTION

Hereinafter, the present invention is described according to embodiments with reference to drawings attached hereto. FIG. 1 is a plan view showing a cutting tool according to one embodiment of the invention. As shown in FIG. 1, a cutting tool 1 is provided with a cutting tool body 11, a notching blade 12, and a grooving blade 13.

Figure 2:
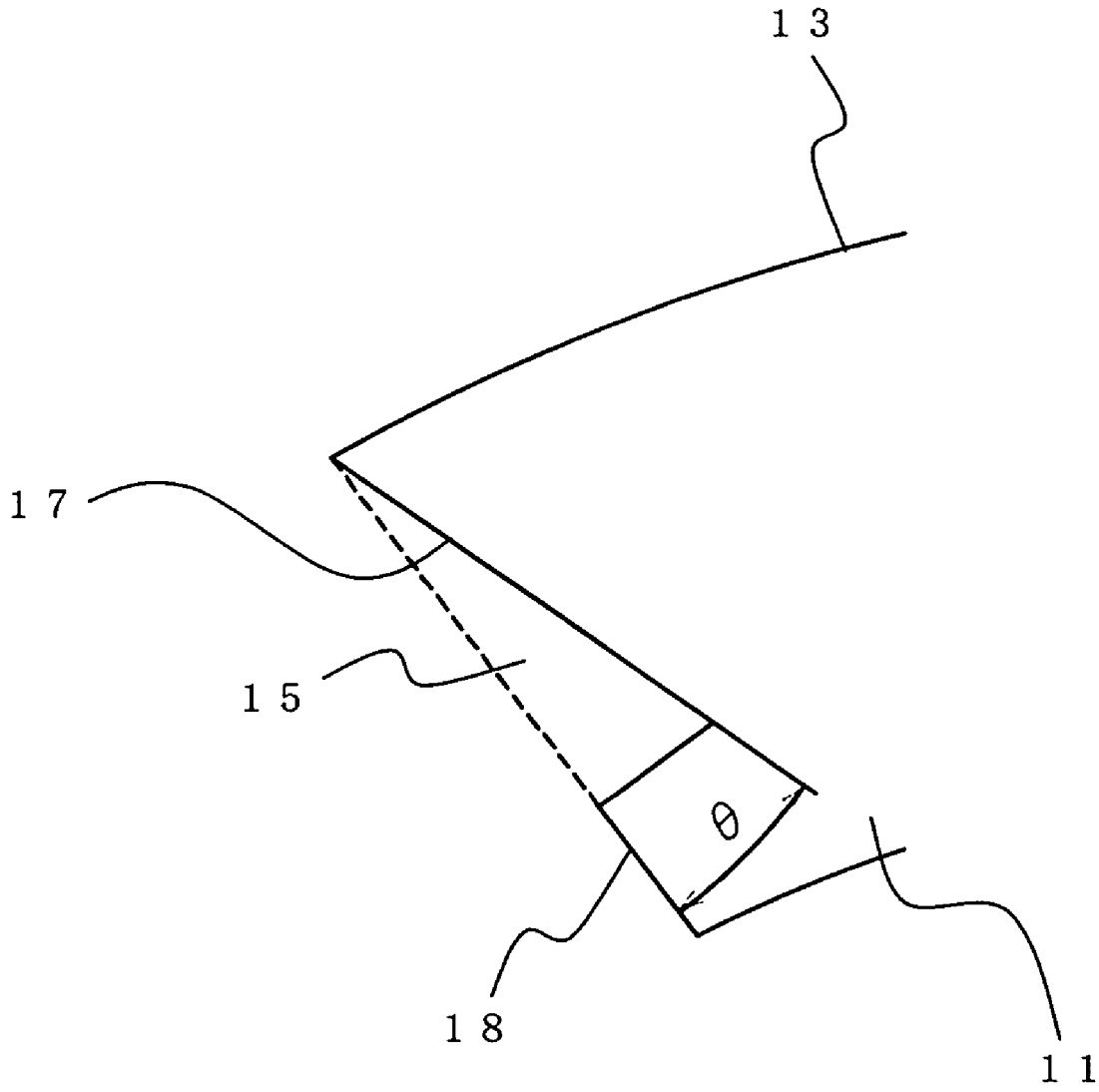
FIG. 2 is an enlarged plan view of a notch of the cutting tool body of FIG. 1.

The cutting tool body 11 is formed in the shape of a fan, i.e. in an arcuate shape, and is provided with a notch 15 and an attachment hole 16. As shown in FIG. 2, the notch 15 is formed by cutting one end of the cutting tool body 11 in the shape of an approximate triangle as viewed from the plan view, and has a back face 17 which is inclined at an angle θ to an end surface 18 of the cutting tool body 11. The angle θ is preferably within a range of 5° to 30°, and more preferably, within a range of 10° to 20°. In this embodiment, the angle θ is set to 15°. The attachment hole 16 is a hole for attaching the notching blade 12 to the cutting tool body 11 with a bolt 14, and is formed on the back face 17.

Figure 3:
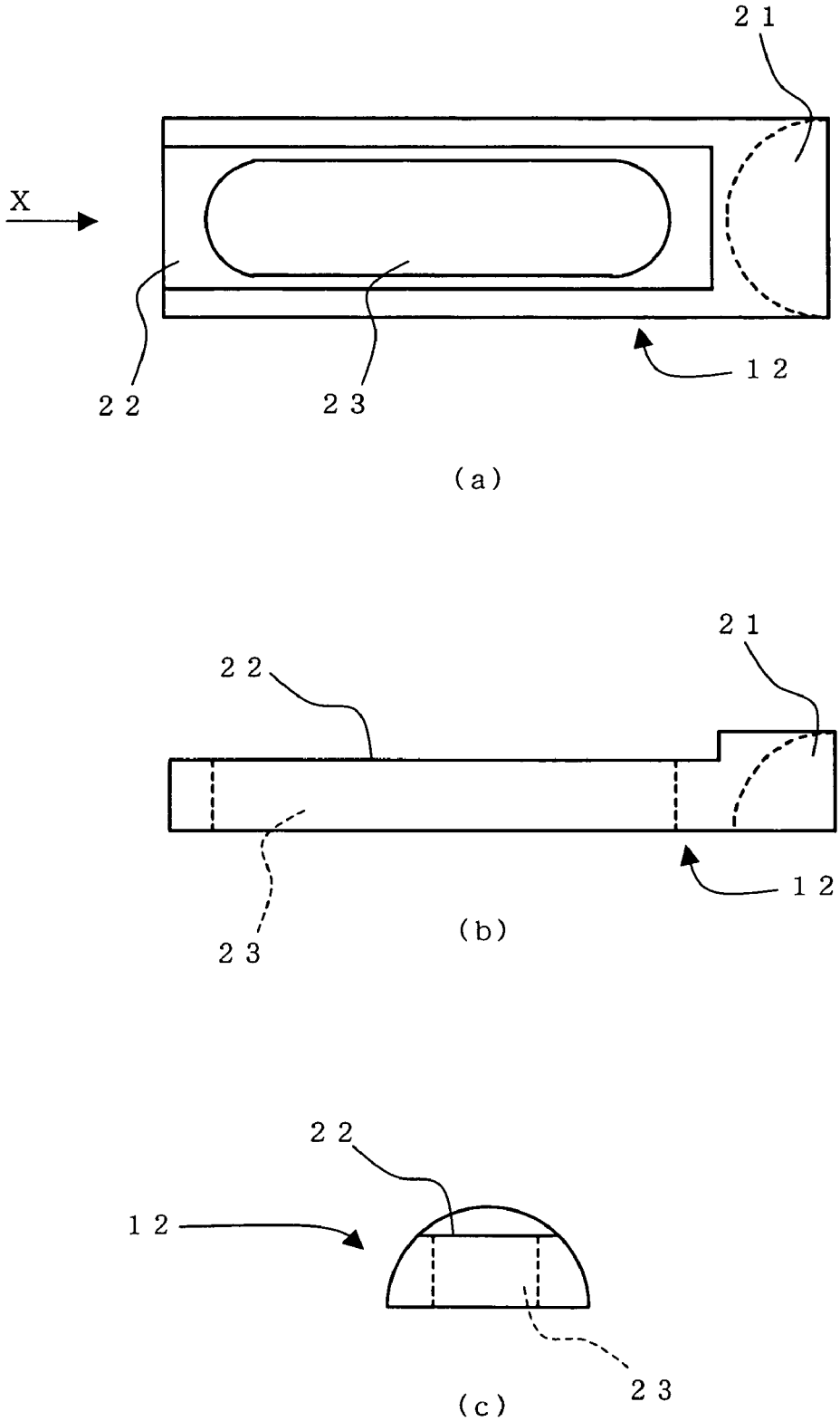
FIG. 3(*a*) is a plan view of a notching blade as viewed from the top, FIG. 3(*b*) is a side view of FIG. 3(*a*), and FIG. 3(*c*) is a side view of the notching blade as viewed from the direction of (X).

The configuration of the notching blade 12 is schematically shown in FIG. 3. FIG. 3(*a*) is a plan view of a notching blade 12 as viewed from the top, FIG. 3(*b*) is a side view of FIG. 3(*a*), and FIG. 3(*c*) is a side view of the notching blade as viewed from the direction of (X). As shown in FIG. 3, the notching blade 12 has a semi-cylindrical blade edge 21 and an attachment site 22 for changing the radial position of the blade edge 21 with respect to the cutting tool body 11. The blade edge 21 is cut at one end of the back side as shown by the dotted lines of FIG. 3(*a*) and (*b*), thereby forming a blade on the outer periphery of the one cut end. The attachment site 22 has an oblong hole 23 on a plane whose periphery is partially cut.

Figure 10:
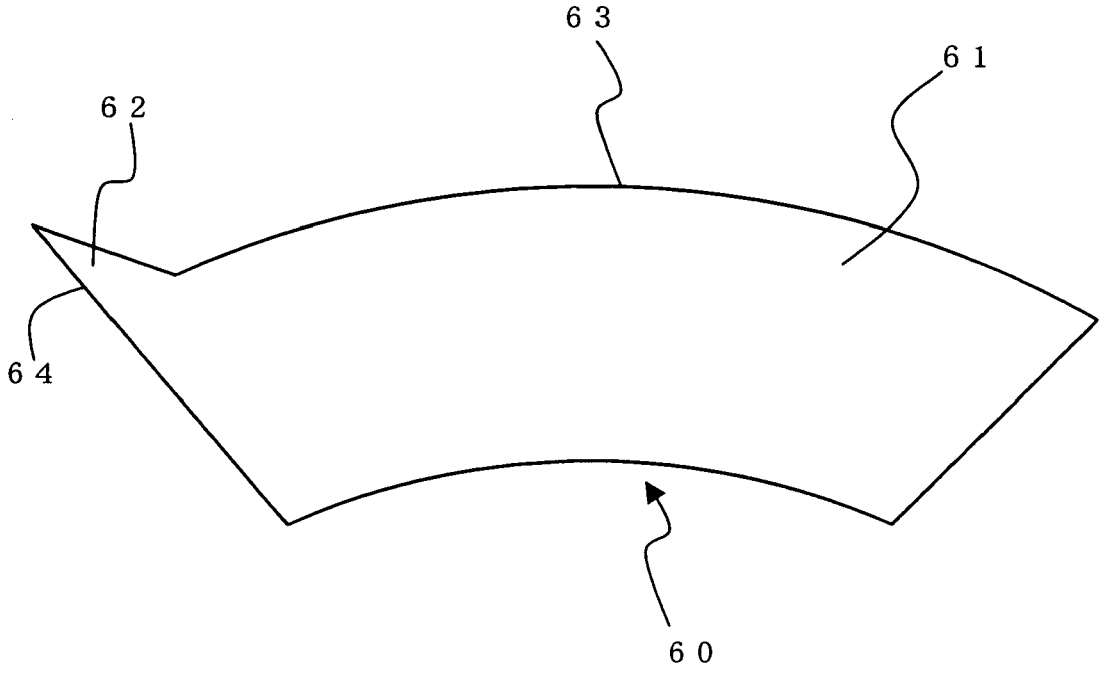
FIG. 10 PRIOR ART
FIG. 10 is a plan view of a prior-art cutting tool.

The grooving blade 13 is formed on either side of the cutting tool body 11 in the thickness direction along the outer surface of the cutting tool body 11 in the same manner as in the prior-art cutting tool 60 (see FIG. 10).

Hereinafter, an explanation is given to a method for forming a slit in a corrugated sheet using the cutting tool 1 configured as described above.

Figure 4:
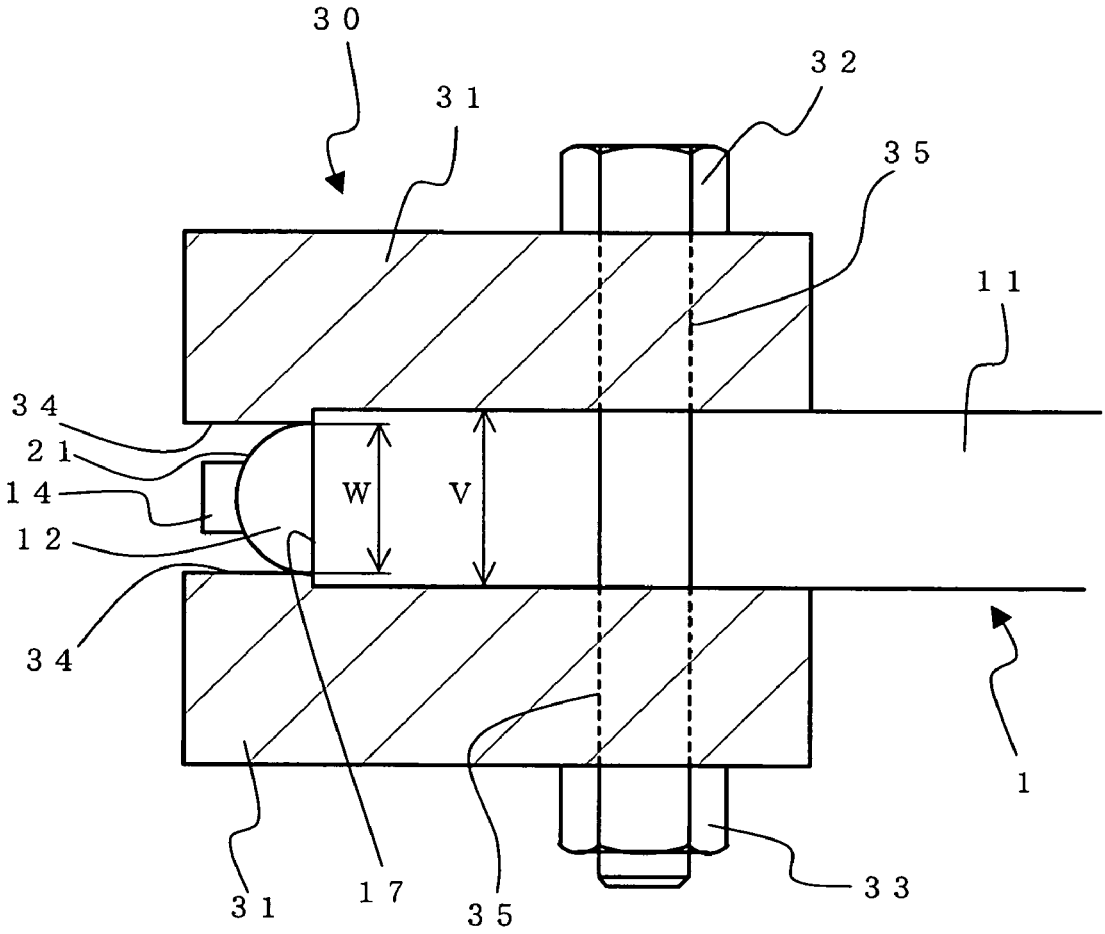
FIG. 4 is a side view of a fixing jig for attaching the notching blade to the cutting tool body.

First, the notching blade 12 is attached to the cutting tool body 11. A fixing jig 30 as shown in FIG. 4 is preferably used for this attachment.

This fixing jig 30 is provided with a pair of plates 31 and 31, a bolt 32, and a nut 33. The pair of plates 31 and 31 have through holes 35 and 35 through which the bolt 32 passes, and projections 34 and 34 are formed on one end of each opposing side of the pair of plates 31 and 31, respectively.

The notching blade 12 is attached to the cutting tool body 11 by hooking the projections 34 and 34 of the fixing jig 30 on the angled portions of the back face 17, and simultaneously fixing the cutting tool body 11 with the bolt 32 and the nut 33 in such a manner as to sandwich the same with the plates 31 and 31. Next, the notching blade 12 is inserted in the gap between the plates 31 and 31, and then is attached to the back face 17 with the bolt 14. After the attachment of the notching blade 12 is complete, the fixing jig 30 is removed.

By using this fixing jig 30, the gap size into which the notching blade 12 is inserted can be kept constant. Therefore, it is possible to easily prevent the notching blade 12 from being displaced when fixing the notching blade 12 to the cutting tool body 11 with the bolt 14, thereby attaching the notching blade 12 in position.

In this process, the width W of the notching blade 12 is preferably shorter by 0.1 mm to 0.3 mm than the thickness V of the cutting tool body 11. The notching blade 12 having a width W that is not in this range can be used, but an excessively small width W increases the level difference in the back face 17 between the notching blade 12 and the cutting tool body 11, which raises the possibility that the slit beginning portion 54 of the back slit 52 may be partially left uncut due to the existence of the level difference. On the other hand, an excessively large width W makes it difficult to hook the projections 34 and 34 of the fixing jig 30 on the angled portions of the back face 17, which makes it difficult to precisely attach the notching blade 12 to the cutting tool body 11 and to form the slit beginning portion 54 of the back slit 52 in the desired shape.

The position of the blade edge 21 with respect to the outer periphery of the cutting tool body is suitably determined in accordance with the thickness or hardness of the corrugated sheet 50 on which the back slit 52 is formed, the rotation rate of the axes of rotation 71 and 72 of the grooving device, etc. The blade edge 21 may be arranged inside or outside with respect to the outer periphery of the cutting tool body 11 in the radial direction. For example, the position of the blade edge 21 can be adjusted in a range from 5 mm toward the inside to 10 mm toward the outside with respect to the outer periphery of the cutting tool body 11 in the radial direction.

In this embodiment, the notching blade 12 is attached using the fixing jig 30. However, the notching blade 12 may be attached without using the fixing jig 30 by forming a key part on the bottom flat surface of the notching blade 12 shown in FIG. 3 and forming a key slot corresponding to the key part in the back face 17 shown in FIG. 2.

Figure 5:
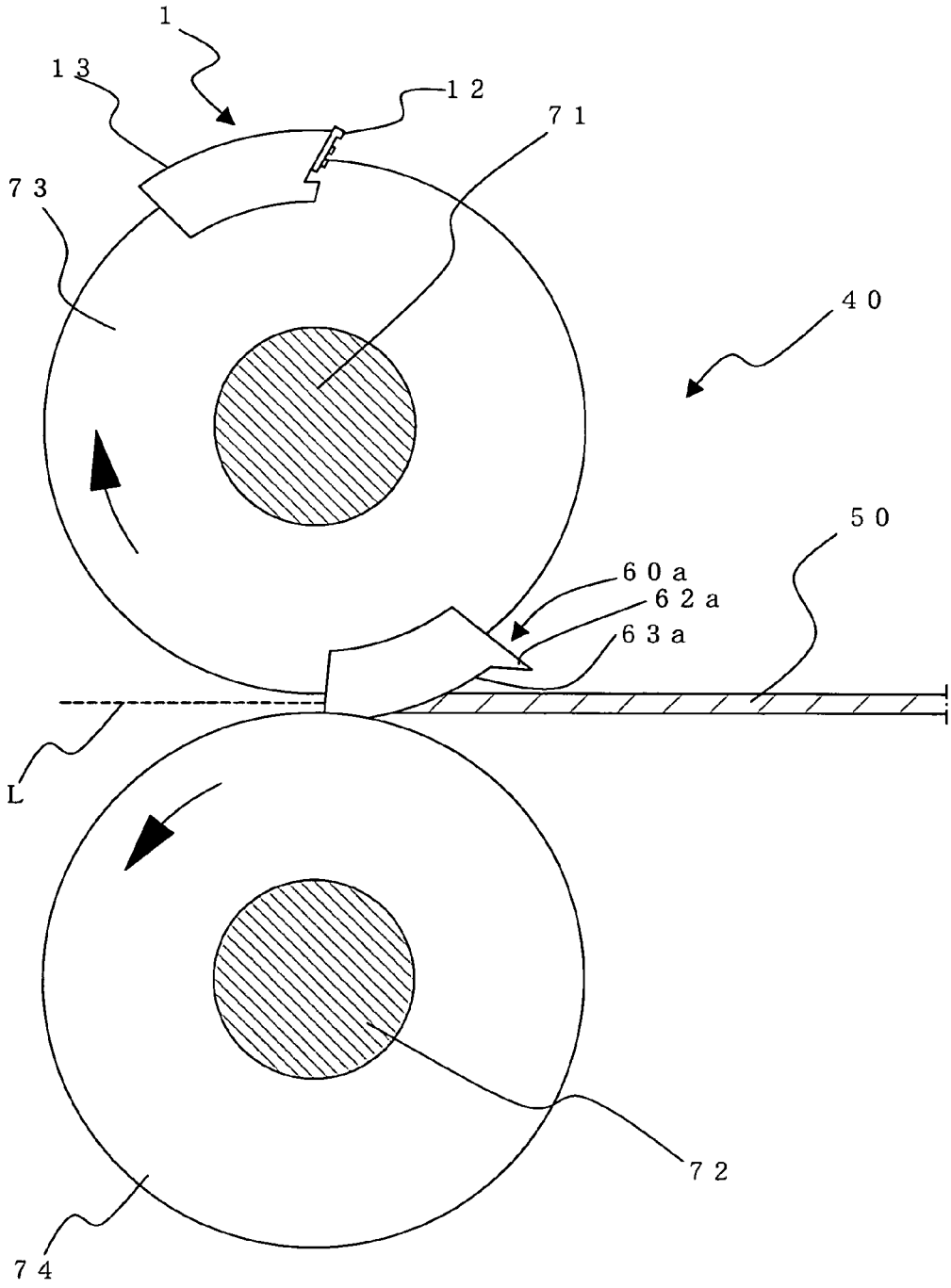
FIG. 5 is a side view schematically showing the configuration of a grooving device provided with the cutting tool of FIG. 1.
Figure 11:
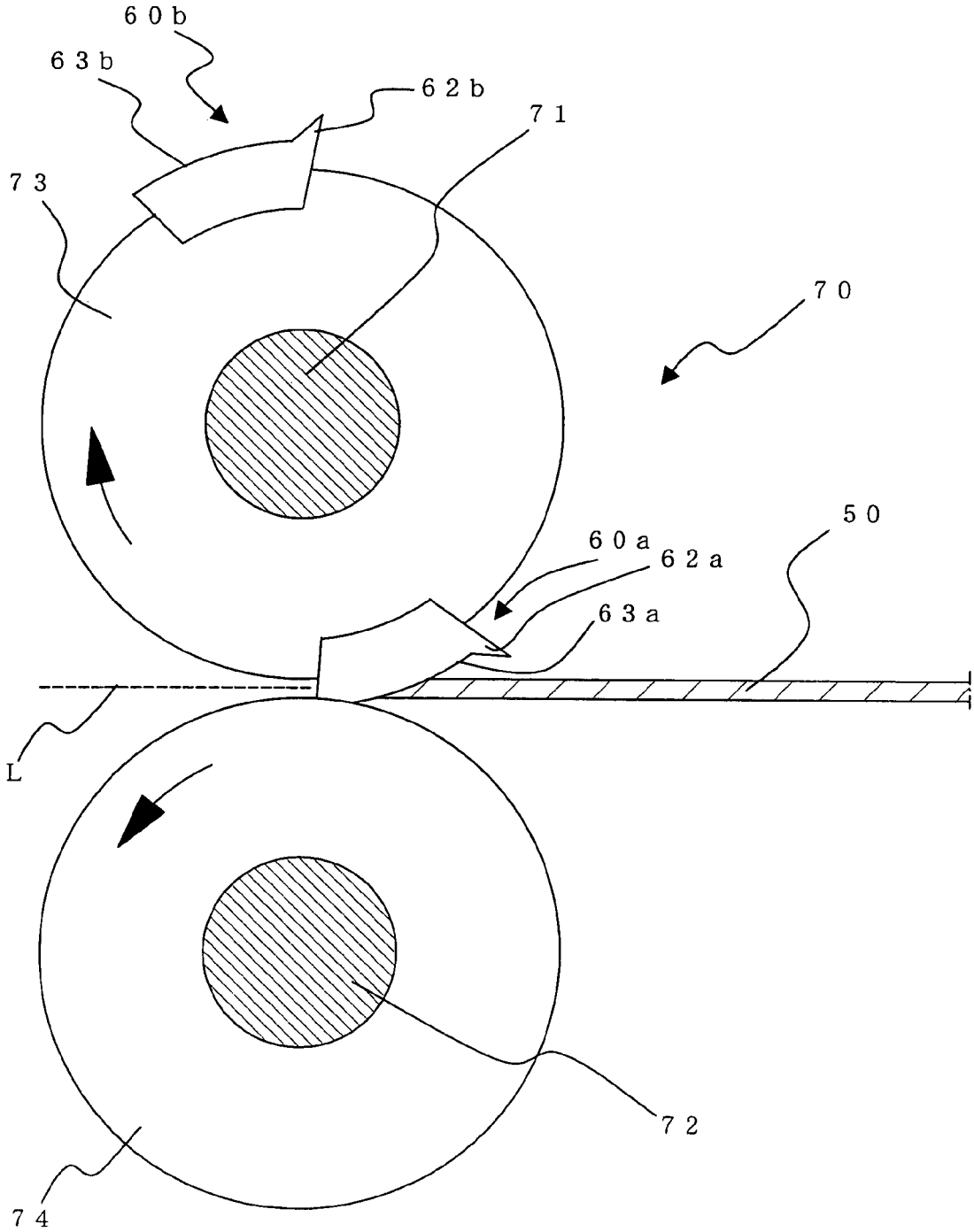
FIG. 11 PRIOR ART
FIG. 11 is a side view schematically showing a grooving device provided with the cutting tool of FIG. 10.

Next, the cutting tool 1 in which the notching blade 12 is attached to the cutting tool body 11 is attached in a rotary holder 73 of a grooving device 40 as shown in FIG. 5. Since the basic configuration of the grooving device 40 is the same as the grooving device 70 shown in FIG. 11 described in BACKGROUND OF THE INVENTION, the detailed description of the grooving device 40 is omitted and the same reference numerals are given to the same parts as in the grooving device 70. The cutting tool 1 is attached to the grooving device 40 at a position corresponding to a prior-art cutting tool 60*b* of FIG. 11 in such a manner that the notching blade 12 and a notching blade 62*a* may face each other along the outer periphery direction.

Figure 9:
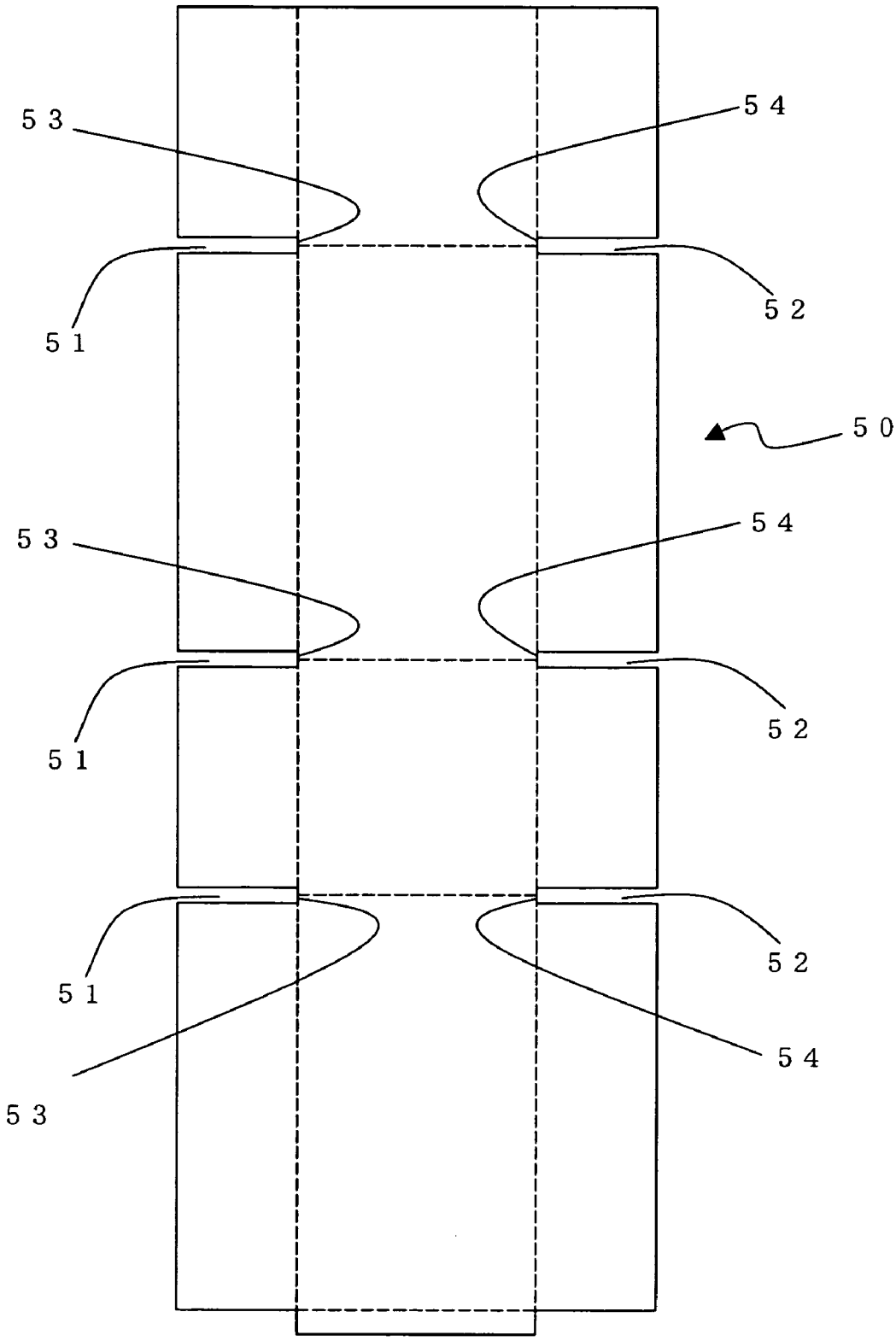
FIG. 9 is a plan view schematically showing a corrugated sheet with slits.

As shown in FIG. 5, while the pair of upper rotary holders 73 and 73 and the pair of lower rotary holders 74 and 74 are rotated, the corrugated sheet 50 is fed to the grooving device 40 from the right as seen in FIG. 5 along the sheet feed line L of the grooving device 40. By the rotation of the holders, the cutting tool 60*a* is placed in the gap between the receiving blades 75 and 75 to cut the corrugated sheet 50, thereby forming a front slit 51 which ends at a slit terminal end 53 as shown in FIG. 9. In the same manner, the cutting tool 1 of the invention is placed in the gap between the receiving blades 75 and 75 to cut the corrugated sheet 50, thereby forming a back slit 52 which extends from the slit beginning portion 54.

Figure 6:
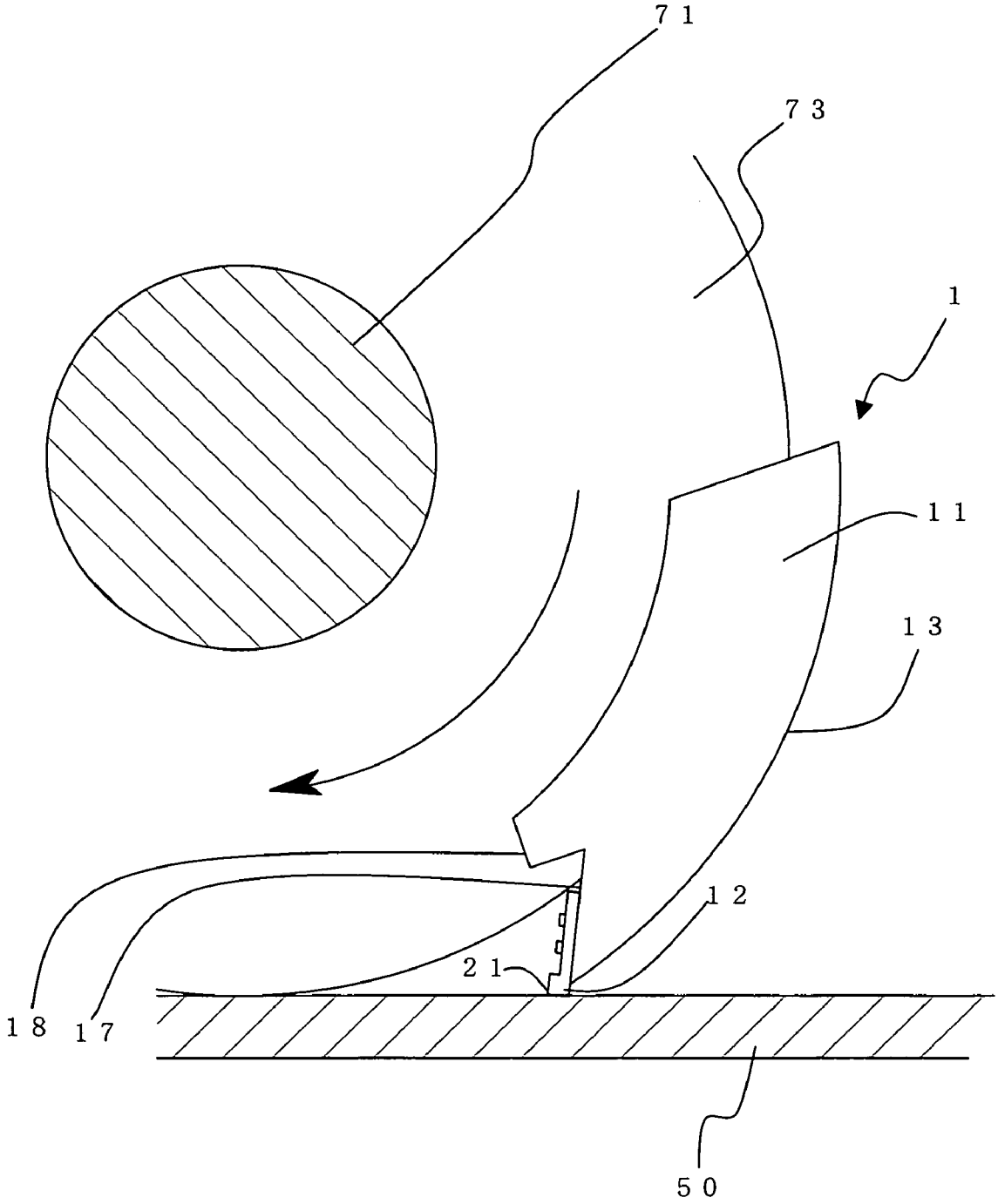
FIG. 6 is an enlarged side view showing a principal part in which the cutting tool of FIG. 1 starts forming a back slit on a corrugated sheet.
Figure 7:
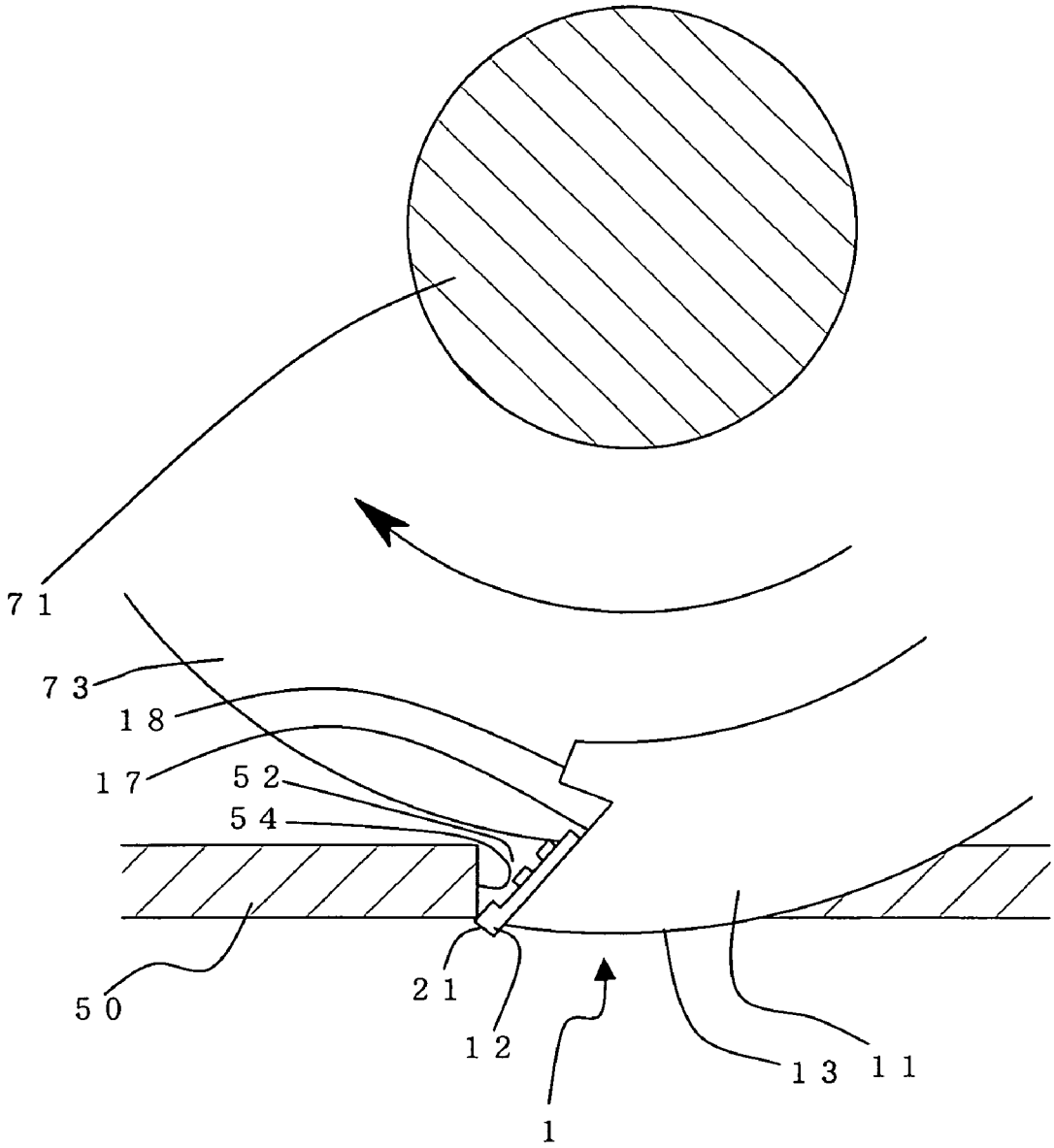
FIG. 7 is an enlarged side view showing a principal part in which the cutting tool of FIG. 1 starts forming a back slit on a corrugated sheet.

When the back slit 52 is formed with the cutting tool 1 as shown in FIG. 9, the cutting tool 1 and the corrugated sheet 50 are positioned as shown in FIG. 6. The notching blade 12 digs into the corrugated sheet 50, thereby forming the slit beginning portion 54 (see FIG. 9) of the back slit 52. Then, as shown in FIG. 7, as the corrugated sheet 50 is fed, the upper holder 73 equipped with the cutting tool 1 rotates in the direction of the arrow around the rotation axis 71. This rotation moves the notching blade 12 upward cutting through the corrugated sheet 50, and simultaneously a grooving blade 13 forms the back slit 52. When the back end portion of the corrugated sheet 50 is cut, scraps are separated from the corrugated paper 50.

Since the blade edge 21 of the notching blade 12 has a semi-cylindrical shape, there is no angled portion 64 formed therein as there is in the notching blade 62 of the prior-art cutting tool 60 shown in FIG. 10 at the contact surface between the side wall of the slit beginning portion 54 and the notching blade 12. Therefore, even when the notching blade 12 digs into the corrugated sheet 50 (see FIG. 6) and the blade edge 21 depresses the side wall of the beginning end portion 54 of the back slit 52, the slit beginning portion 54 is not damaged, such as a split. In the same manner, even when the notching blade 12 moves upward cutting through the corrugated sheet 50 (see FIG. 7), and the blade edge 21 pushes up the side wall of the slit beginning portion 54 of the back slit 52, the slit beginning portion 54 is not damaged, such as a split. Thus, a fine slit beginning portion 54 can be formed.

In this embodiment, the notching blade 12 is attached to the back face 17, which is inclined at 5° to 30° with respect to the end surface 18 of the cutting tool body 11. As shown in FIG. 6, according to this configuration, the notching blade 12 digs into the corrugated sheet while preventing the blade edge 21 of the notching blade 12 from depressing the side wall of the slit beginning portion 54, which enables the notching blade 12 to smoothly dig into the corrugated sheet 50. Therefore, damage, such as a split, to the slit beginning portion 54 can be more surely prevented, and the impact of the notching blade 12 contacting the corrugated sheet 50 can be reduced.

Moreover, as shown in FIG. 7, when the notching blade 12 moves upward cutting through the corrugated sheet 50, the blade edge 21 easily moves upward to cut through the corrugated sheet 50. Therefore, damage to the slit beginning portion 54 can be surely prevented. In particular, when the back face 17 is inclined with respect to the end surface 18 within a range of 10° to 20°, the blade edge 21 can smoothly dig into the corrugated sheet 50 and smoothly move upward into the corrugated sheet 50.

Moreover, since the notching blade 12 of this embodiment has an oblong hole 23 as shown in FIG. 3 at the attachment site 22, the radial position of the blade edge 21 with respect to the cutting tool body 11 (see FIG. 1) can be suitably adjusted in the range corresponding to the dimensions of the oblong hole. According to this configuration, it is possible to prevent the slit from being partially left uncut (see FIG. 7), and, in addition, the blade edge 21 can be disposed in the optimal position where the blade edge 21 of the notching blade 12 does not push upon the slit beginning portion 54 of the corrugated sheet 50 when the notching blade 12 moves upward cutting through the corrugated sheet 50, thereby surely preventing the slit beginning portion 54 from being damaged.

Figure 8:
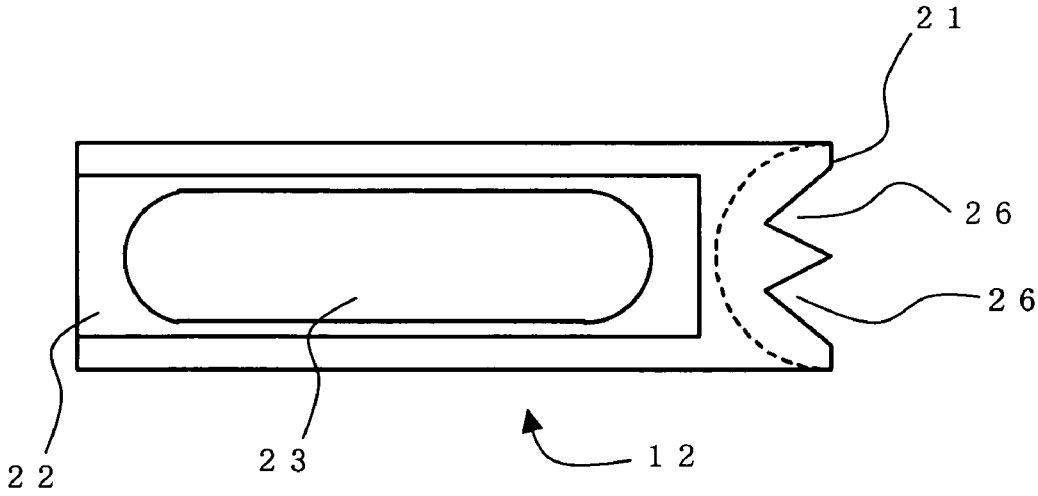
FIG. 8 is a plan view showing a modified example of the notching blade of FIG. 3.

The notching blade 12 of this embodiment is equipped with a semi-cylindrical blade edge as shown in FIG. 3, and one or two or more notches 26 may be formed at the tip of the outer curved surface of the blade edge 21 as shown in FIG. 8. As shown in FIG. 7, by forming the notch(es) 26, the contact area between the notching blade 12 and the slit beginning portion 54 of the back slit 52 can be decreased when the notching blade 12 moves upward cutting through the corrugated sheet 50. Therefore, damage, such as a split, to the slit beginning portion 54 can be surely prevented.

Figure 12:
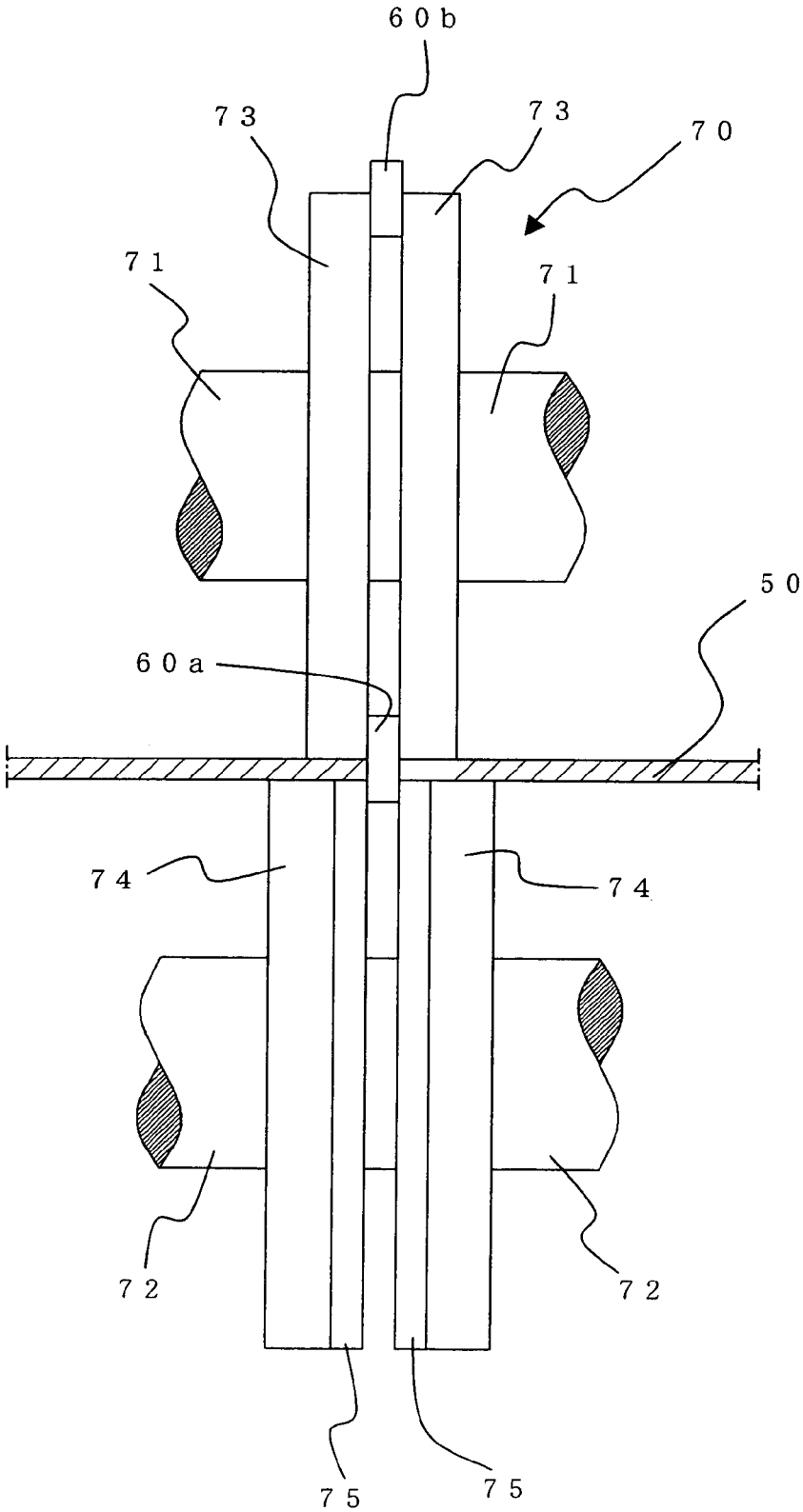
PRIOR ART FIG. 12
FIG. 12 is an elevation view schematically showing a grooving device provided with the cutting tool of FIG. 10.
Figure 13:
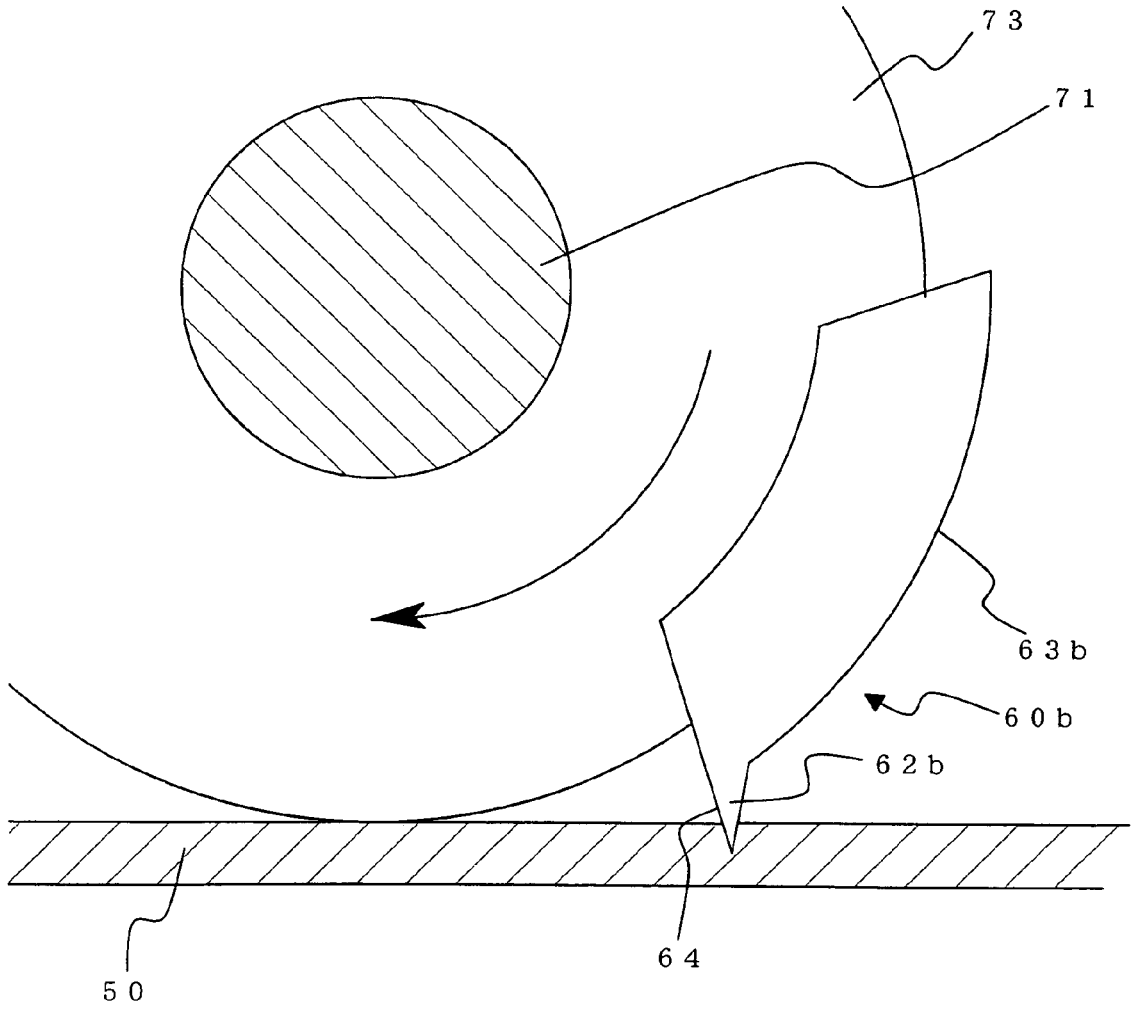
FIG. 13 PRIOR ART
FIG. 13 is an enlarged side view of a principal part in which a slit beginning portion is damaged, such as a split, when an angled portion of the notching blade of the cutting tool of FIG. 10 depresses the beginning portion of the back slit of the corrugated sheet.
Figure 14:
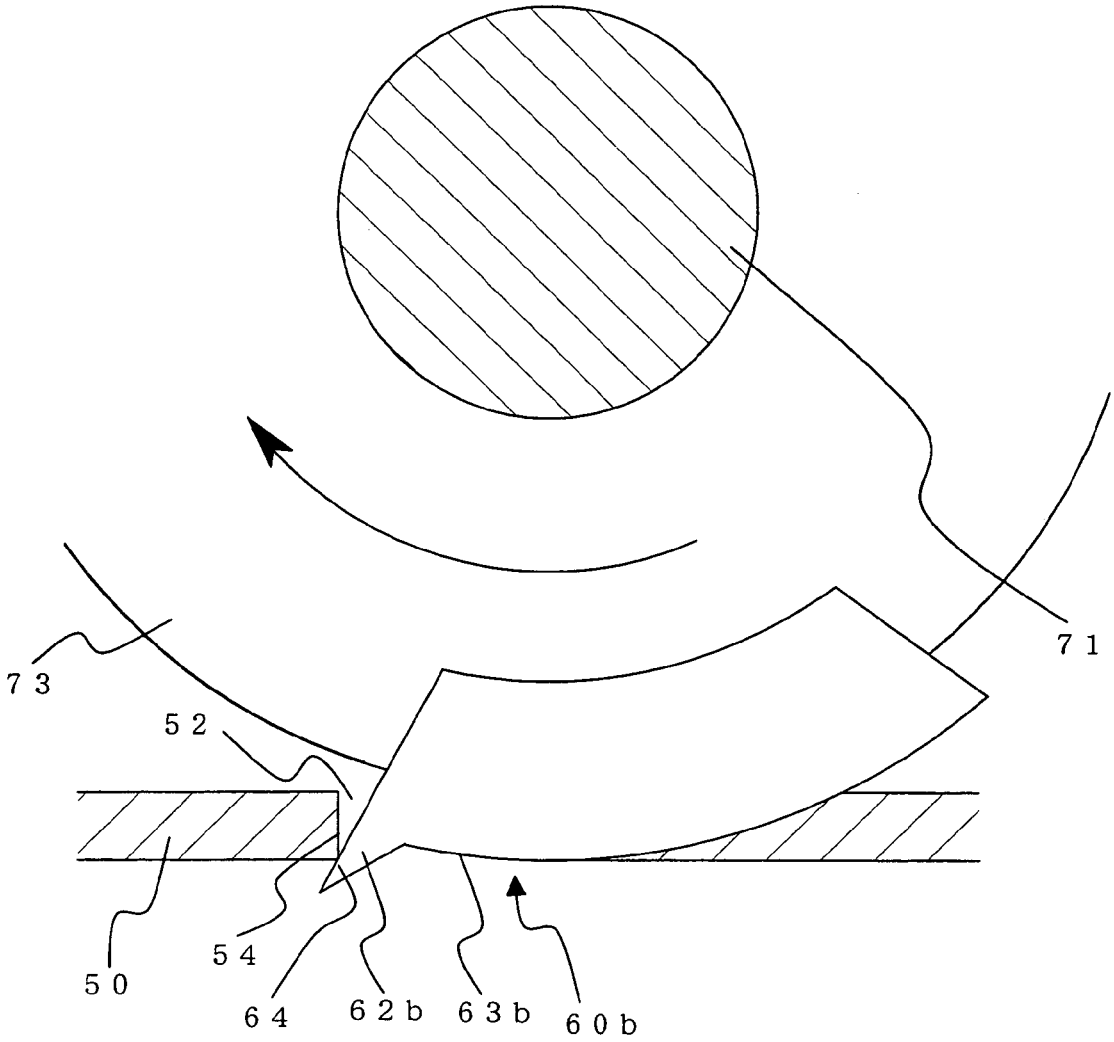
FIG. 14 PRIOR ART
FIG. 14 is an enlarged side view of a principal part in which a slit beginning portion is damaged, such as a split, when an angled portion of the notching blade of the cutting tool of FIG. 10 pushes up the beginning portion of the back slit of the corrugated sheet.

In the cutting tool 1 of this embodiment, the notching blade 12 can be detachably attached to the cutting tool body 11. Therefore, even if the tip of the notching blade 12 is broken on contact with the receiving blades 75 and 75 (see FIG. 12) due to displacement between the receiving blades 75 and 75 and the notching blade 12 during the formation of a slit in the corrugated sheet, the notching blade 12 can be easily exchanged using the fixing jig 30 shown in FIG. 4. Accordingly, even then the notching blade is chipped, the service life of the grooving blade 13 can be fulfilled, thereby reducing production cost.

Moreover, as shown in FIG. 3, the notching blade 12 of this embodiment has a configuration in which the oblong hole 23 is formed on the attachment site 22 so that the radial position of the blade edge 21 with respect to the cutting tool body 11 can be adjusted in a range corresponding to the dimensions of the oblong hole. However, configurations for adjusting the position are not limited to this, and the position of the blade edge 21 can be adjusted using the following configuration. More specifically, two or more insertion holes for bolt insertion are provided in the attachment site 22, and simultaneously two or more bolt holes are also formed in the back face 17 of the cutting tool body 11. By combining the bolt holes and the insertion holes, respectively, to pass bolts through the holes, the blade edge 21 is fixed to the cutting tool body 11 with the bolts. Thus, the radial position of the blade edge 21 with respect to the cutting tool body 11 can be suitably adjusted.

This embodiment relates to the cutting tool 1 for forming a slit in a corrugated sheet, but, needless to say, can be applied to a sheet material other than a corrugated sheet, such as synthetic resins, or the like.

As shown in FIG. 5, the cutting tool 1 of this embodiment is used for forming the back slit 52, and may be used for forming the front slit 51 instead of the cutting tool 60*a*. The back end of the front slit and the slit beginning portion of the back slit can thus be made into the same shape.

The invention claimed is:

1. A cutting tool for forming a slit on a sheet material, the cutting tool comprising:

a cutting tool body, a grooving blade for forming a slit, and a notching blade for forming an end portion of a slit, wherein the cutting tool body is formed in an accurate shape, the grooving blade is formed along either edge along the thickness direction of the cutting tool body, the notching blade is provided with a semi-cylindrical blade edge and an attachment site capable of being detachably attached to one end of the cutting tool body, and the notching blade is attached to one end of the cutting tool body in such a manner that an outer curved surface of the blade edge is exposed outside the cutting tool body, and the attachment site is configured such that the blade edge can be adjusted in the radial direction, relative to a rotating axis of the cutting tool, of the cutting tool body, wherein the attachment site is provided with an oblong hole, and the notching blade is attached to the cutting tool body by inserting a bolt, via the oblong hole, into a bolt hole formed in one end surface of the cutting tool body.

2. The cutting tool according to claim 1, wherein the cutting tool body has a notch formed on one end, which forms a back face inclined at an angle of 5° to 30° to and end surface, and the notching blade is attached to the back face.

3. The cutting tool according to claim 1, wherein the notching blade is provided with a notch at the tip of the blade.

4. The cutting tool according to claim 1, wherein the width of the notching blade is 0.1 mm to 0.3 mm less than that of the cutting tool body.

5. The cutting tool according to claim 2, wherein the notching blade is provided with a notch at the tip of the blade.

6. The cutting tool according to claim 2, wherein the width of the notching blade is 0.1 mm to 0.3 mm less than that of the cutting tool body.

7. The cutting tool according to claim 3, wherein the width of the notching blade is 0.1 mm to 0.3 mm less than that of the cutting tool body.

* * * * *